US007413529B2

(12) United States Patent
Lee et al.

(10) Patent No.: US 7,413,529 B2
(45) Date of Patent: Aug. 19, 2008

(54) FOLDABLE TREADMILL

(75) Inventors: Sunny Lee, Nan-Tou Hsien (TW); Simon Chao, Nan-Tou Hsien (TW)

(73) Assignee: Sunny Lee, Nan-Tou Hsien (TW)

( * ) Notice: Subject to any disclaimer, the term of this patent is extended or adjusted under 35 U.S.C. 154(b) by 867 days.

(21) Appl. No.: 10/937,999

(22) Filed: Sep. 10, 2004

(65) Prior Publication Data

US 2006/0058160 A1 Mar. 16, 2006

(51) Int. Cl.
*A63B 22/02* (2006.01)

(52) U.S. Cl. ..... 482/54; 482/51

(58) Field of Classification Search ..... 482/51–54, 482/70, 71

See application file for complete search history.

(56) References Cited

U.S. PATENT DOCUMENTS

| | | | | |
|---|---|---|---|---|
| 7,081,069 | B2 * | 7/2006 | Hsu | 482/54 |
| 7,166,065 | B2 * | 1/2007 | Chang | 482/54 |
| 7,329,209 | B2 * | 2/2008 | Lo | 482/54 |
| 2002/0068664 | A1 * | 6/2002 | Tsou | 482/54 |
| 2005/0096189 | A1 * | 5/2005 | Chen | 482/54 |
| 2005/0159273 | A1 * | 7/2005 | Chen | 482/54 |
| 2005/0164840 | A1 * | 7/2005 | Chen | 482/54 |

* cited by examiner

*Primary Examiner*—LoAn H. Thanh
*Assistant Examiner*—Tam Nguyen
(74) *Attorney, Agent, or Firm*—Christie, Parker & Hale, LLP

(57) ABSTRACT

A treadmill includes a front leg frame and a connecting arm. The front leg frame has a front end pivoted to a support base. The connecting arm has a lower end pivoted to the leg frame. An upper end of the connecting arm is connected to a threaded sleeve connected telescopically to a motor-driven screw rod disposed at a top side of a tread base. A hydraulic telescopic unit is pivoted to the leg frame and the support base. When the threaded sleeve is driven by the screw rod, the tread base is inclined. When the tread base is folded upward, it is held in position by the hydraulic telescopic unit which is prevented from moving telescopically by engagement with a latch member. The latch member disengages the telescopic unit through a release member provided on the tread base.

19 Claims, 9 Drawing Sheets

FOLDABLE TREADMILL

BACKGROUND OF THE INVENTION

1. Field of the Invention

This invention relates to a treadmill, more particularly to a treadmill which is foldable and which can be raised to an inclined position.

2. Description of the Related Art

FIGS. 1 and 2 show a conventional treadmill which includes a support frame 1, an instrument panel 2, a tread base 3, a front leg frame 4, a linear actuator 5 and two hydraulic lifting units 6. The support frame 1 includes two slide rails 101. The instrument panel 2 is mounted on the support frame 1. The front end of the tread base 3 has two mounting arms 301 connected pivotally to the support frame 1. The front leg frame 4 has upper ends connected pivotally to the tread base 3 and lower ends provided with wheels 401 which are disposed slidably in the respective slide rails 101. The linear actuator 5 is mounted on the bottom of the tread base 3 and includes a screw rod 502 driven by a motor 501 and a threaded sleeve 503 connected telescopically to the screw rod 502 and connected pivotally to the front leg frame 4. Each hydraulic lifting unit 6 has a front hydraulic cylinder 601 mounted pivotally on the support frame 1 and a rear piston rod 602 connected pivotally to the tread base 3.

When the tread base 3 is to be raised to an inclining position for the user to exercise thereon, the screw rod 502 of the linear actuator 5 is rotated by the motor 501 to retract the threaded sleeve 503. The front leg frame 4 is thus pulled and the wheels 401 are moved along the slide rails 101 so that the mounting arms 301 are inclined and the tread base 3 are raised by the front leg frame 4.

Referring to FIG. 3, when the tread base 3 is to be folded for storage, the linear actuator 5 is first operated to extend forward the threaded sleeve 503 so as to place the tread base 3 in a horizontal position. Then, the tread base 3 is lifted upward manually so that the hydraulic lifting unit 6 is extended and turned upward together with the tread base 3. At this juncture, a spring latch 302 provided on the tread base 3 is automatically moved into a latch hole 201 of the instrument panel 2, thereby positioning the tread base 3. The tread base 3 is further stabilized in its folded upward position by the hydraulic lifting unit 6.

However, the conventional treadmill has a disadvantage in that the construction thereof is rather complicated and that the spring latch 302 is unsafe as it can drop from the latch hole 201 due to vibration. In addition, when the tread base 3 is to be unfolded for use, the user must pull out the spring latch 302 from the latch hole 201 with one hand while holding the tread base 3 with another hand to prevent the tread base 3 from falling down accidentally. The need to pull out the spring latch 302 is therefore troublesome.

SUMMARY OF THE INVENTION

An object of the present invention is to provide a treadmill which has an improved mechanism for inclining and folding a tread base and which has a latch member that can be operated easily to control a hydraulic telescopic unit for holding a tread base in a folded state.

According to one aspect of the present invention, a treadmill comprises: a support base having a front end, a rear end, and an upright frame extending upward from the support base adjacent the front end; a tread base carrying an endless belt and having a bottom side and a top side; a front leg frame attached to the tread base and connected pivotally to the support base adjacent the front end of the support base; a connecting arm having a lower end fixedly connected to the front leg frame and an upper end which extends upward; an inclining unit including a motor mounted on the tread base at the top side, a screw rod connected to the motor at the top side, and a threaded sleeve disposed movably around the screw rod and connected to the upper end of the connecting arm; and a hydraulic telescopic unit having a rear end pivoted to the support base and a front end connected pivotally to the front leg frame, the hydraulic telescopic unit being extendable and retractable.

According to another aspect of the present invention, a treadmill comprises: a support base having a front end, a rear end, and an upright frame extending upward from the support base adjacent the front end; a tread base carrying an endless belt; a front leg frame connected movably between the tread base and the support base; an inclining unit for moving the front leg frame so as to incline the tread base, the inclining unit including a motor, a screw rod connected to the motor, and a threaded sleeve disposed movably around the screw rod; and a hydraulic telescopic unit connected to the tread base and the support base and being extendable to maintain the tread base in an upward folded state; a latch member mounted on the hydraulic telescopic unit to engage the hydraulic telescopic unit so that the hydraulic telescopic unit is prevented from moving telescopically when the tread base in the folded state; and a release member connected to the latch member for disengaging the latch member from the hydraulic telescopic unit.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
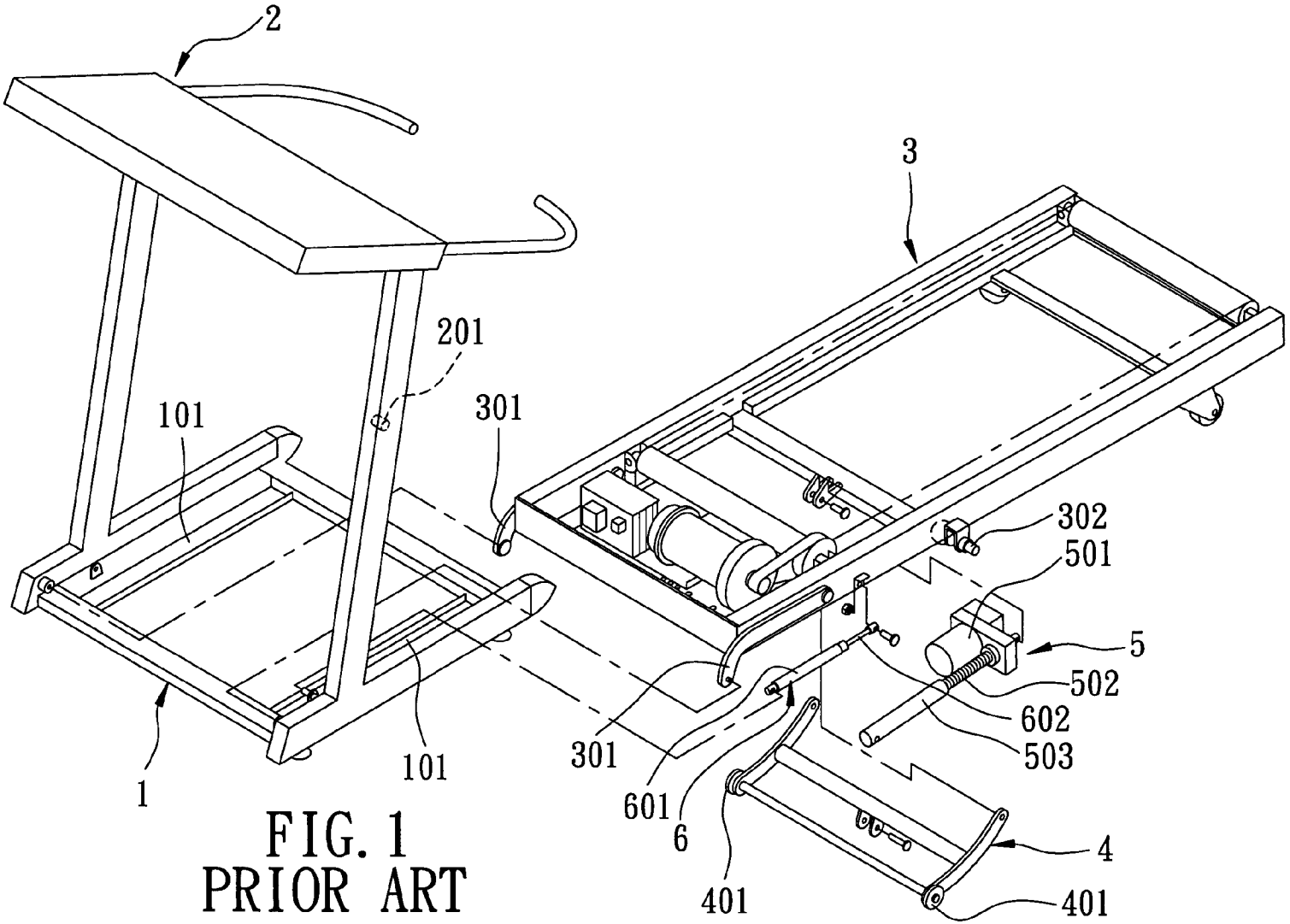
FIG. 1 PRIOR ART
FIG. 1 is an exploded view of the conventional treadmill.
Figure 2:
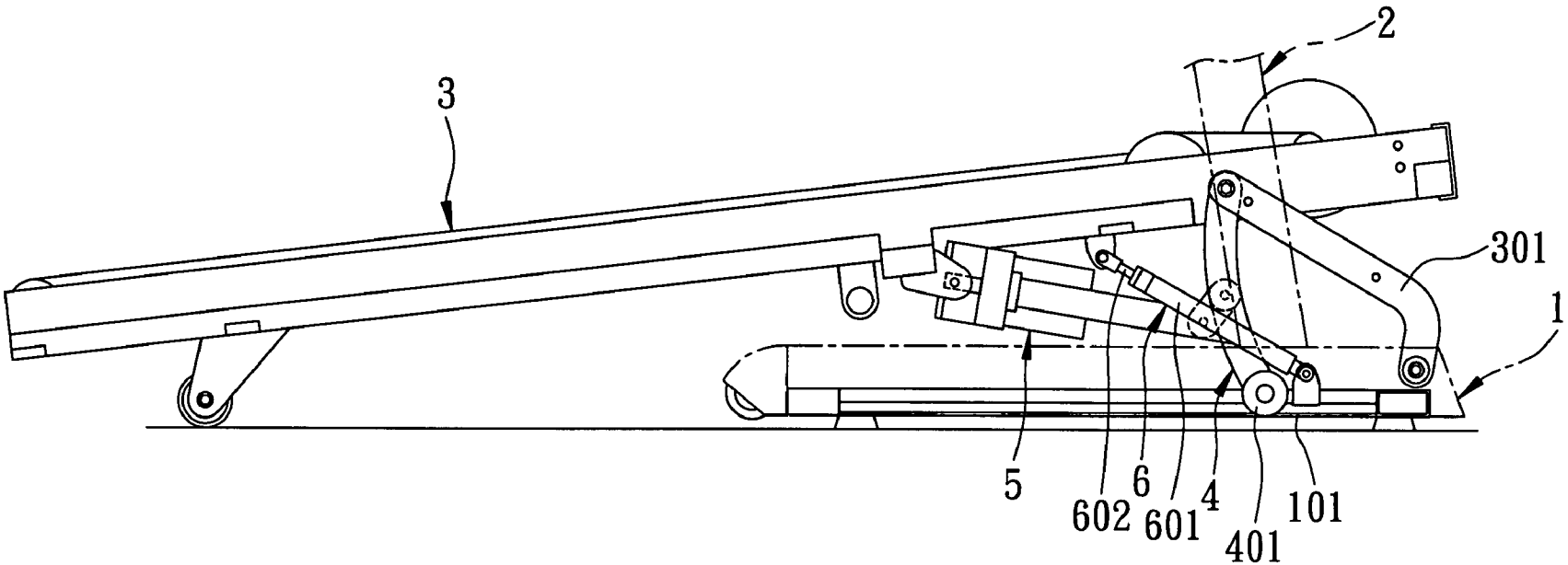
FIG. 2 PRIOR ART
FIG. 2 shows the conventional treadmill in an inclined position.
Figure 3:
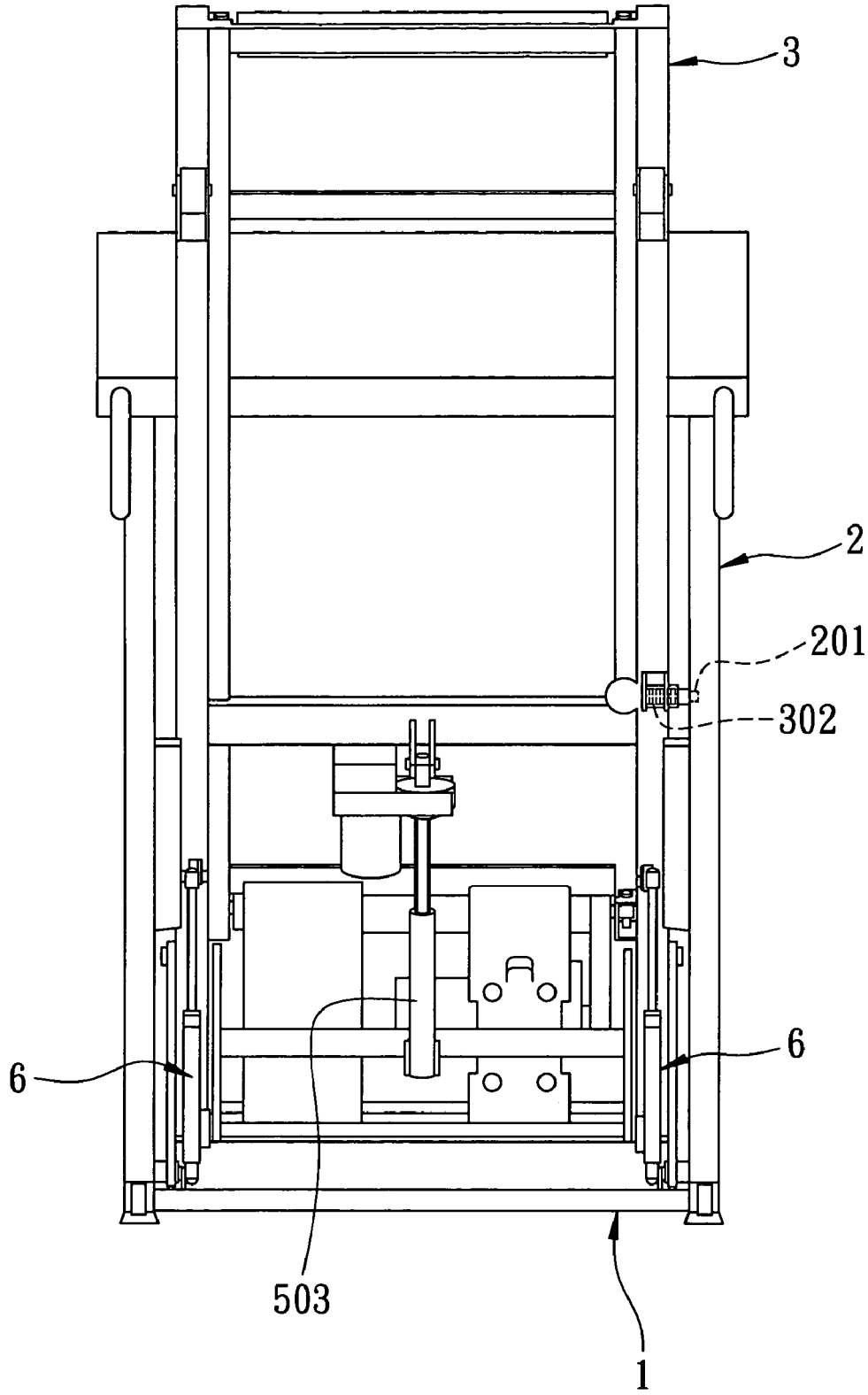
FIG. 3 PRIOR ART
FIG. 3 shows the conventional treadmill in a folded position.
Figure 4:
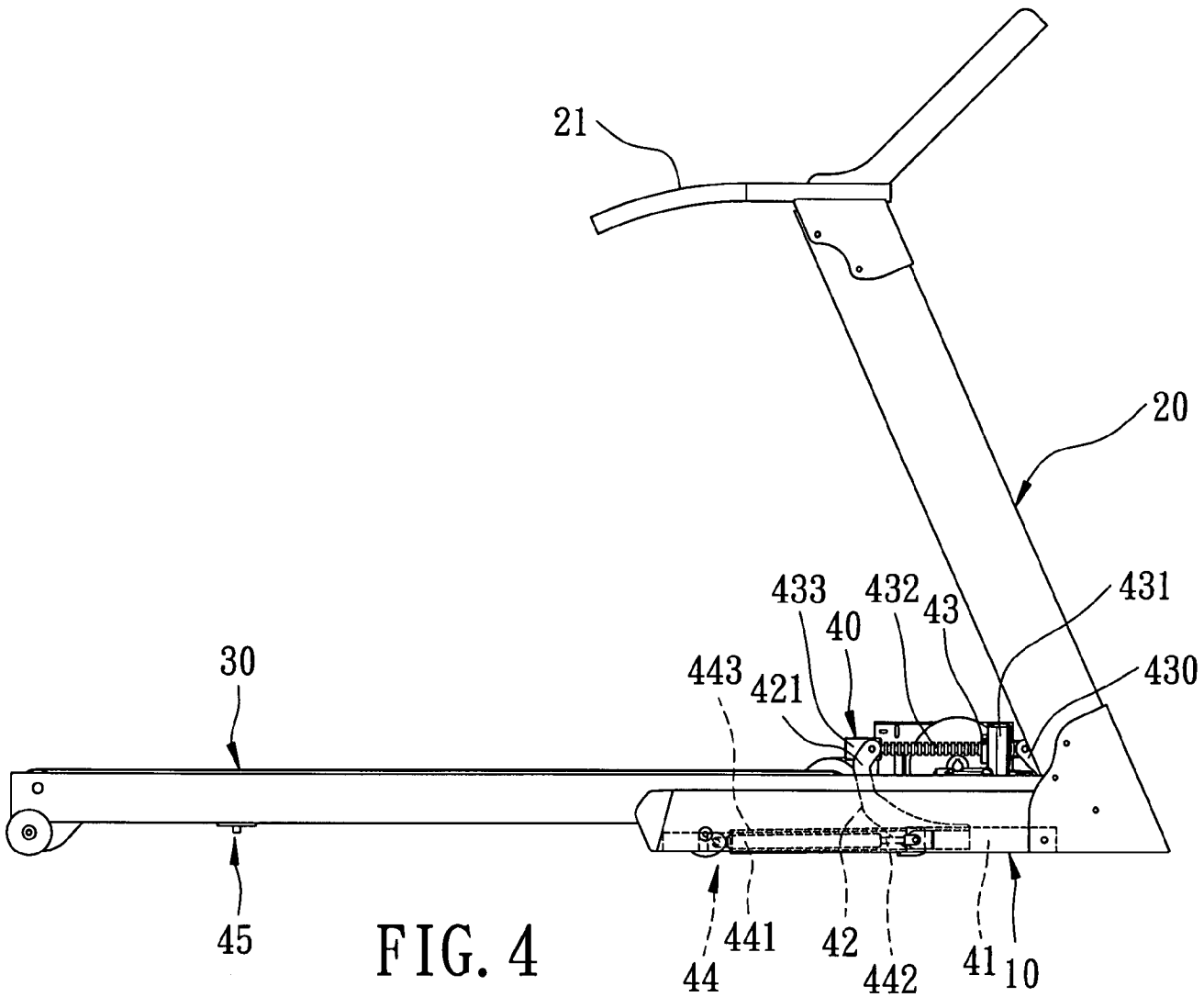
FIG. 4 is a side view of a preferred embodiment of the treadmill according to the present invention.
Figure 5:
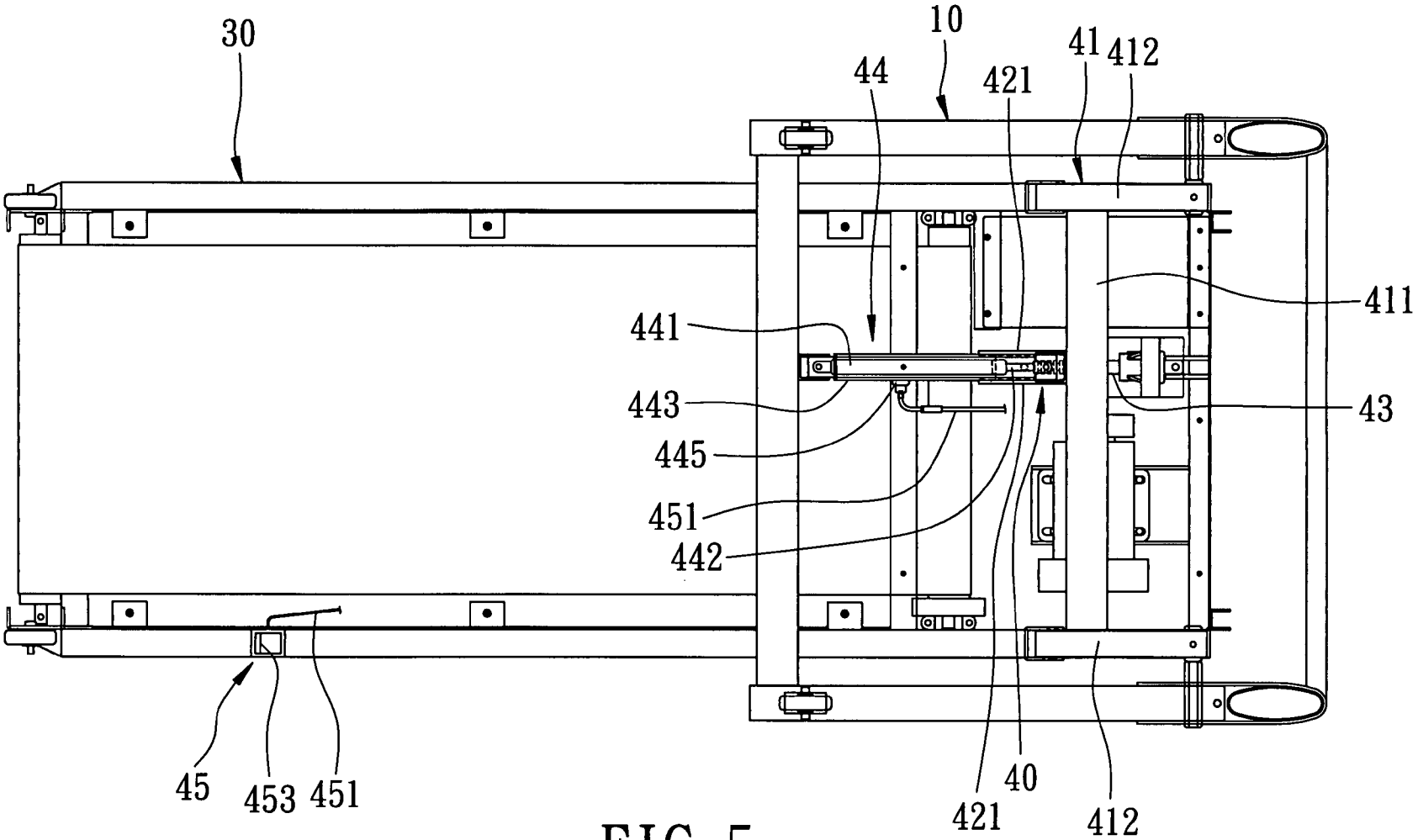
FIG. 5 is a bottom view of the preferred embodiment.

Referring to FIGS. 4 to 8, a treadmill embodying the present invention is shown to include a four-sided support base 10 having two upright posts 20 carrying an instrument panel 21. A tread base 30 is mounted pivotally on the support base 10 and includes an endless belt (not shown). Since the constructions of the support base 10 and the tread base 30 are conventional, they will not be detailed hereinafter.

The present invention resides in a mechanism 40 for raising the tread base 30 to an inclining position and for lifting the tread base 30 to a folded position. The mechanism 40 includes a front leg frame 41 which is disposed below the tread base 30 and which has a transverse rod 411 connected between left and right support arms 412. The support arms 412 have respective front ends which are pivoted to the support base 10 and respective rear ends which are pivoted to the tread base 30. Intermediate parts of the support arms 412 are connected respectively to two opposite ends of the transverse rod 411.

The mechanism 40 further includes a connecting arm 42 which is composed of a pair of curve plates 421 that have lower ends fixedly connected to the transverse rod 411 between the support arms 412 and upper ends extending upwardly to a level above a top side of the tread base 30.

The upper ends of the curved plates 421 are connected to an inclining unit 43 which includes a motor 431 mounted on the tread base 30 through a bracket 430 provided at the front end of the tread base 30, a screw rod 432 connected to the motor 431 to be driven by the motor 431, and a threaded sleeve 433 connected telescopically to the screw rod 432. The motor 431 is thus disposed above the top side of the tread base 30. The threaded sleeve 433 is connected between the upper ends of the curve plates 421.

The mechanism 40 further includes a hydraulic telescopic unit 44 which has a hydraulic cylinder 441, a piston rod 442 and an outer telescopic tube 443. The hydraulic cylinder 441 has a rear end connected pivotally to a rear end of the support base 10. The piston rod 442 is connected to the hydraulic cylinder 441 and extends forwardly. A front end of the piston rod 442 is connected pivotally to the intermediate part of the transverse rod 411 between the curve plates 421. The telescopic tube 443 is disposed around the hydraulic cylinder 441 and the piston rod 442 and has a rear end pivoted to the rear end of the support base 10 and a front end connected to the transverse rod 411 between the curve plates 421. The piston rod 442 and the telescopic tube 443 are pivotal about an axis which is coaxial with an axis of rotation of the support arms 412 of the front leg frame 41.

Figure 7:
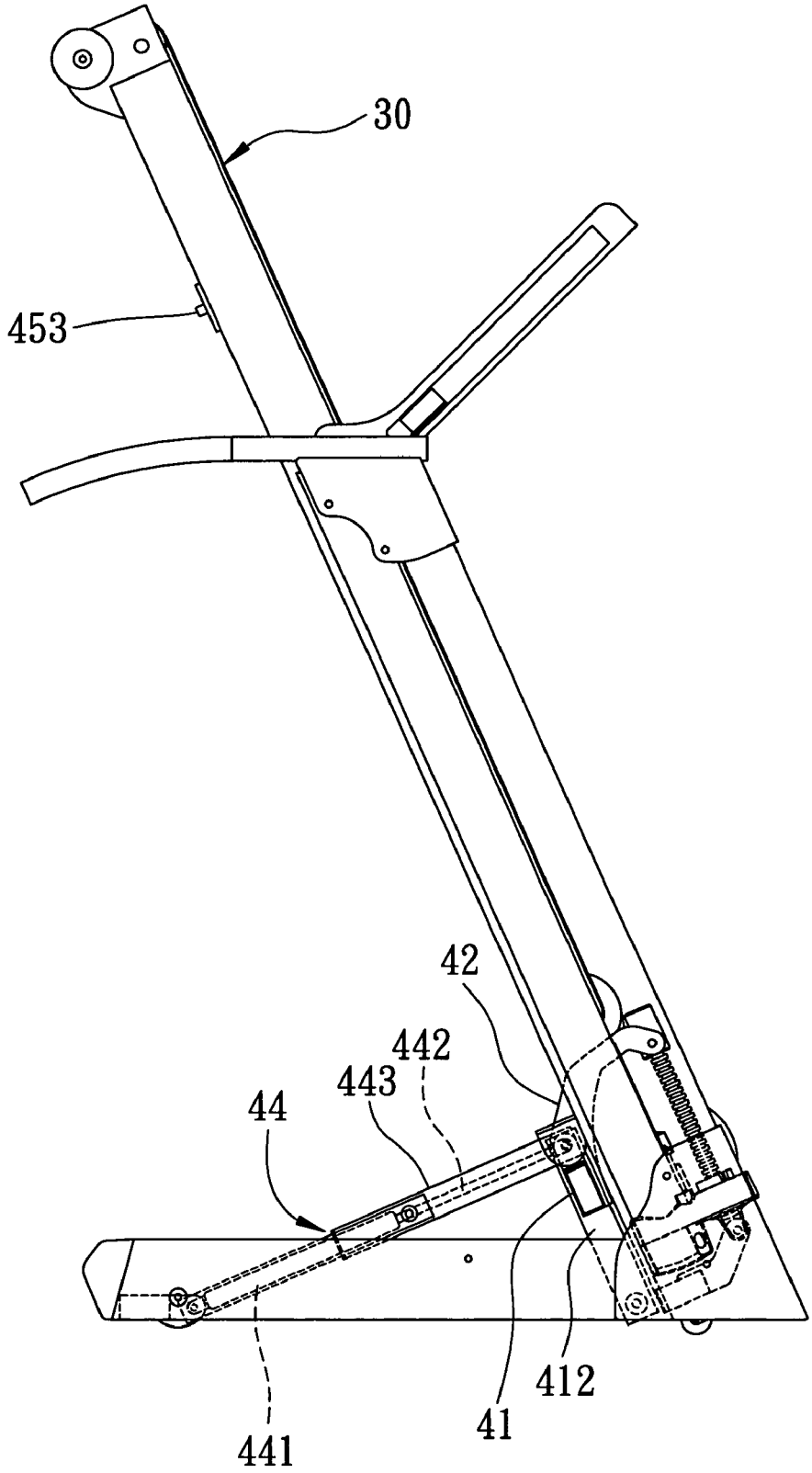
FIG. 7 is the same view as FIG. 4 but with the tread base being in a folded state.
Figure 8:
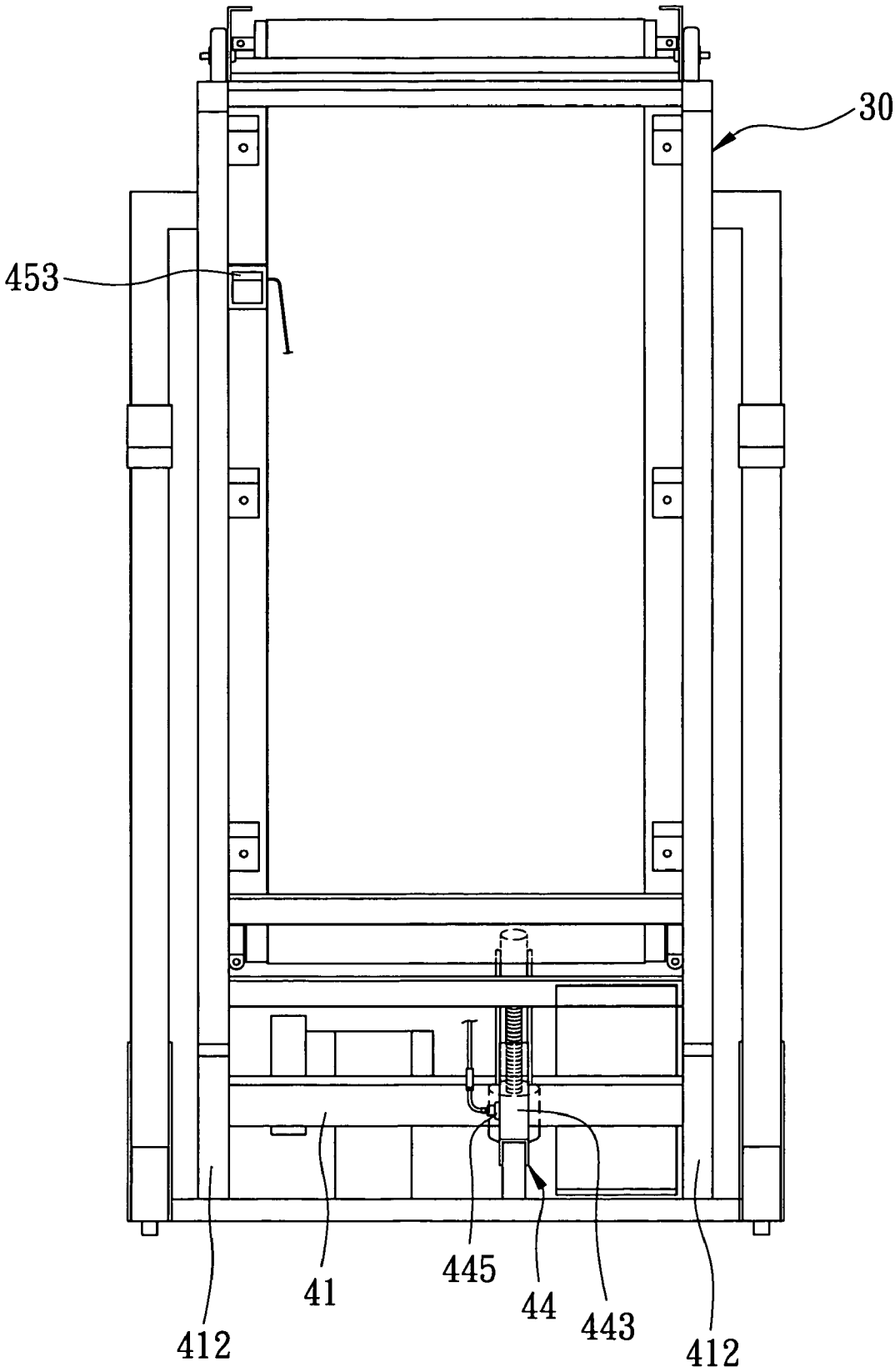
FIG. 8 is a rear view of the tread base in the folded state.
Figure 9:
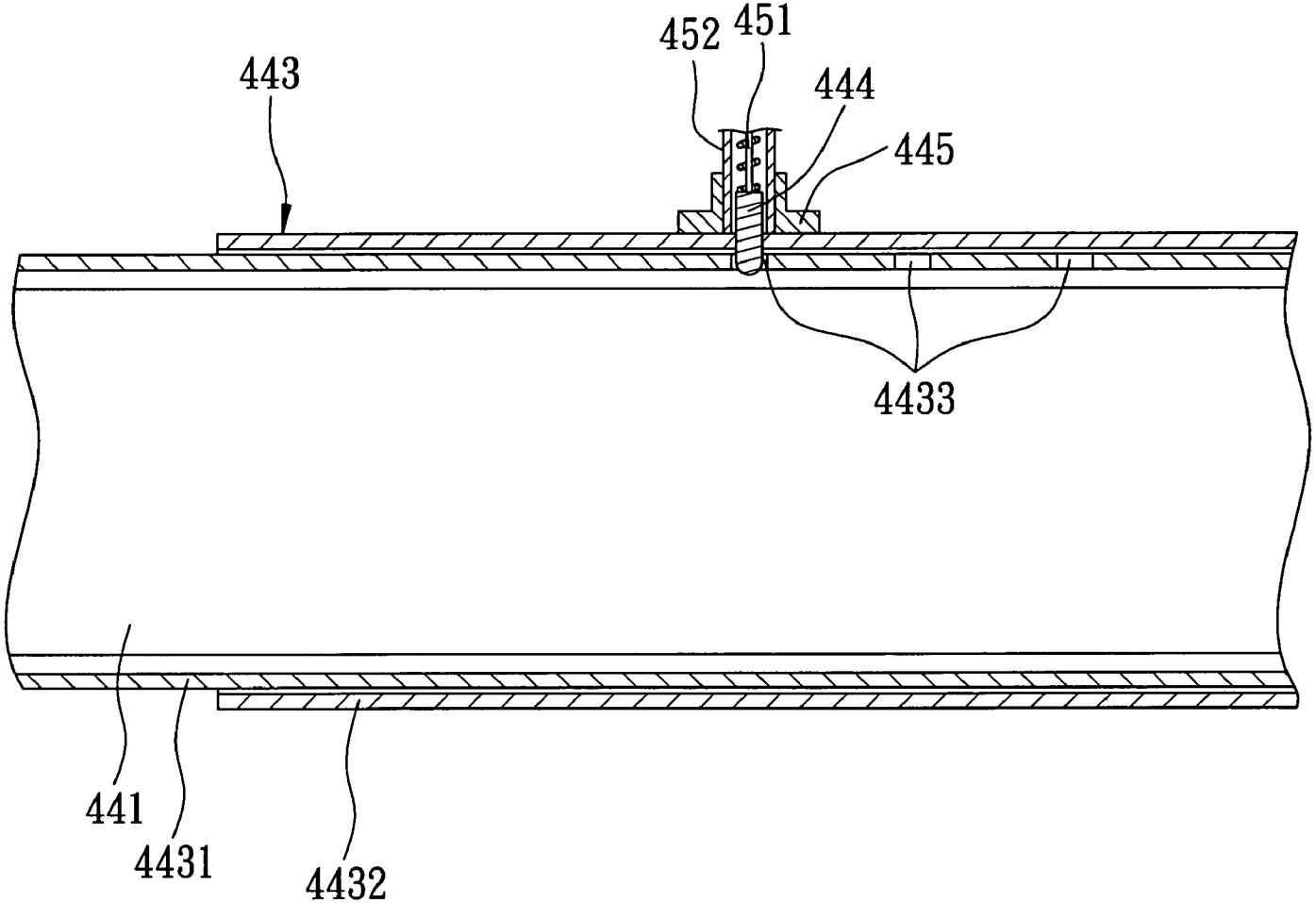
FIG. 9 is a fragmentary view of the hydraulic telescopic unit of the preferred embodiment.

A spring-loaded latch member 444 is mounted on the telescopic tube 443 to prevent the telescopic tube 443 from moving telescopically when the tread base 30 is lifted to a folded position as shown in FIGS. 7 and 8. Referring to FIG. 9 in combination with FIG. 5, the telescopic tube 443 has an inner tube 4431 and an outer tube 4432. The latch member 444 is disposed movably within a seat 445 mounted on the outer tube 4432.

A release member 45 includes a trigger 453 which is disposed on an intermediate part of the tread base 10 and a control cable 451 which is connected to the trigger 453 and the latch member 444 and which extends within a guide tube 452. The latch member 444 is engageable with a selected one of a plurality of slots 4433 formed in the inner tube 4431. The trigger 453 is operable to actuate the control cable 451 so that the latch member 444 is disengaged from the inner tube 4431 to allow the telescopic tube 443 to move telescopically.

Figure 6:
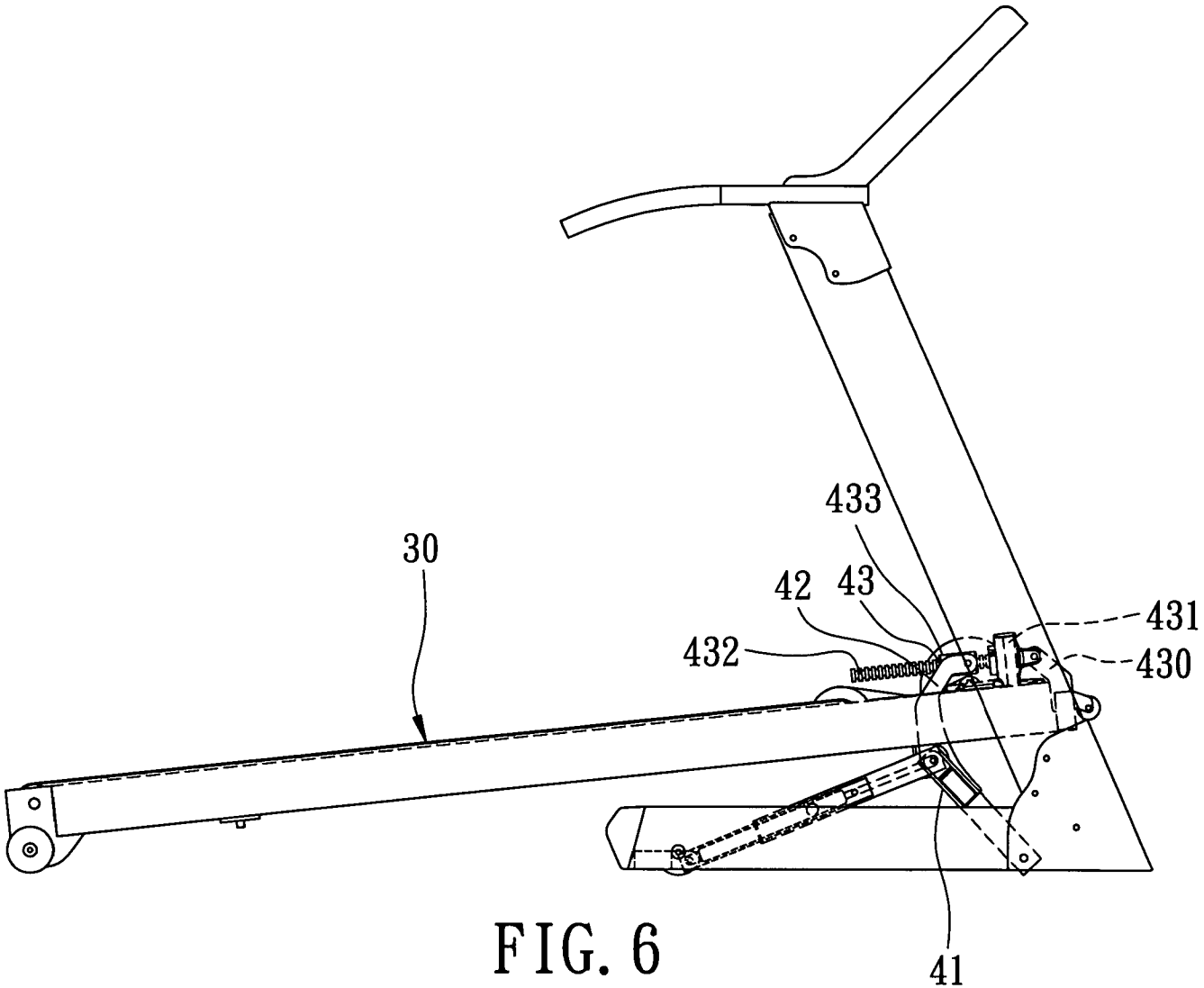
FIG. 6 is the same view as FIG. 4 but with the tread base being in an inclined position.

Referring to FIG. 6, when the tread base 30 is to be raised to an inclined operative position, the motor 431 must be first actuated to rotate the screw rod 432 so that the threaded sleeve 433 is advanced along the screw rod 432. The connecting arm 42 is therefore pulled upward by the threaded sleeve 433, thereby moving upward the front leg frame 41 and raising the tread base 30. Conversely, if the tread base 30 is to be lowered, the rotation of the motor 431 must be reversed so that the threaded sleeve 433 is moved rearward and the connecting arm 42 is moved downward. The inclining angle of the tread base 30 can be adjusted by controlling the operation of the motor 431.

Referring to FIGS. 7 and 8, when the tread base 30 is to be folded, the tread base 30 is first lowered. Then, the tread base 30 is turned upward manually. At this time, the piston rod 442 and the telescopic tube 443 of the hydraulic telescopic unit 44 are pulled outward. When the tread base 30 is lifted to a desired height, the latch member 444 extends into one of the slots 4433 so that the telescopic tube 443 is stopped from moving telescopically. At this juncture, the tread base 30 is held rigidly in its upright folded position by the hydraulic telescopic unit 44. During the operation of lifting the tread base 30, the user may press controlledly the trigger 453 to prevent the latch member 444 from extending into the slots 4433 until the tread base 30 reaches the desired height. When the trigger 453 is released, the latch member 444 is urged to extend into one of the slots 4433.

When the tread base 30 is to be unfolded, the user may turn the tread base 30 downward by holding the tread base 30 with his two hands and by pressing the trigger 453 that is provided at a handy position on the tread base 30 with one of his two hands which hold the tread base 30 so as to release the latch member 444.

Unlike the conventional treadmill, the treadmill of the present invention employs only one hydraulic cylinder 441 in association with the front leg frame 41 and the connecting arm 42. The construction according to the present invention is therefore simplified. Furthermore, since the hydraulic cylinder 441 and the piston rod 442 are concealed within the telescopic tube 443, the outer appearance of the treadmill is enhanced. Moreover, the use of the latch member 444 which can be controlled through the handy trigger 453 facilitates the unfolding operation of the tread base 30.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A treadmill comprising:

a support base having a front end, a rear end, and an upright frame extending upward from said support base adjacent said front end;

a tread base carrying an endless belt and having a bottom side and a top side;

a front leg frame attached to said tread base and connected pivotally to said support base adjacent said front end of said support base;

a connecting arm having a lower end fixedly connected to said front leg frame and an upper end which extends upwardly;

an inclining unit including a motor mounted on said tread base at said top side, a screw rod connected to said motor at said top side, and a threaded sleeve disposed movably around said screw rod and connected to said upper end of said connecting arm; and a hydraulic telescopic unit having a rear end pivoted to said support base and a front end connected directly and pivotally to said front leg frame, said hydraulic telescopic unit being extendable and retractable.

2. The treadmill as claimed in claim 1, further comprising a latch member for engaging said hydraulic telescopic unit so as to prevent said hydraulic telescopic unit from moving telescopically.

3. The treadmill as claimed in claim 2, further comprising a release member connected to said latch member for disengaging said latch member from said hydraulic telescopic unit.

4. The treadmill as claimed in claim 3, wherein said release member is connected to said latch member and is mounted on said tread base to be operated manually.

5. The treadmill as claimed in claim 1, wherein said motor is mounted on said tread base adjacent a front end of said tread base.

6. The treadmill as claimed in claim 1, wherein said front leg frame includes a pair of support arms which have respective front ends pivoted to said support base and respective rear ends, and a transverse rod connected between said support arms adjacent said rear ends of said support arms.

7. The treadmill as claimed in claim 6, wherein said lower end of said connecting arm is fixedly connected to said transverse rod, said connecting arm being curved forwardly from said lower end to said upper end of said connecting arm.

8. The treadmill as claimed in claim 7, wherein said front end of said hydraulic telescopic unit is connected pivotally to said transverse rod.

9. The treadmill as claimed in claim 8, wherein said hydraulic telescopic unit includes a hydraulic cylinder, a piston rod and an outer telescopic tube disposed around said hydraulic cylinder and said piston rod.

10. The treadmill as claimed in claim 9, further comprising a latch member for engaging said outer telescopic tube so as to prevent said outer telescopic tube from moving telescopically, said latch member being mounted on said outer telescopic tube.

11. The treadmill as claimed in claim 10, further comprising a release member connected to said latch member for disengaging said latch member from said outer telescopic tube.

12. The treadmill as claimed in claim 9, wherein said hydraulic cylinder is connected pivotally to said rear end of said support base, said piston rod being connected pivotally to said transverse rod, said outer telescopic tube having a rear end connected pivotally to said rear end of said support base and a front end connected pivotally to said transverse rod.

13. The treadmill as claimed in claim 9, wherein said connecting arm includes a pair of spaced apart curve plates which have respective lower ends fixedly connected to said transverse rod on two sides of said outer telescopic tube and which have respective upper ends connected pivotally to two opposite sides of said threaded sleeve of said inclining unit.

14. The treadmill as claimed in claim 13, wherein said curve plates are curved forwardly from said lower ends to said upper ends of said curve plates.

15. A treadmill comprising:

a support base having a front end, a rear end, and an upright frame extending upward from said support base adjacent said front end;

a tread base carrying an endless belt;

a front leg frame connected movably between said tread base and said support base;

an inclining unit for moving said entire front leg frame so as to incline said tread base, said inclining unit including a motor, a screw rod connected to said motor, and a threaded sleeve disposed movably around said screw rod;

a hydraulic telescopic unit connected directly to said front leg frame and said support base and being extendable to maintain said tread base in an upward folded state;

a latch member mounted on said hydraulic telescopic unit to engage said hydraulic telescopic unit so that said hydraulic telescopic unit is prevented from moving telescopically when said tread base in said folded state; and a release member connected to said latch member for disengaging said latch member from said hydraulic telescopic unit.

16. The treadmill as claimed in claim 15, wherein said hydraulic telescopic unit includes a hydraulic cylinder, a piston rod, and an outer telescopic tube disposed around said hydraulic cylinder and said piston rod.

17. The treadmill as claimed in claim 16, wherein said latch member is engageable with said outer telescopic tube.

18. The treadmill as claimed in claim 17, wherein said outer telescopic tube includes an inner tube and an outer tube which are interconnected telescopically, said latch member being mounted movably on said outer tube and being engageable with said inner tube.

19. The treadmill as claimed in claim 18, wherein said release member includes a control cable connected to said latch member and a trigger connected to said control cable and mounted on said tread base.

* * * * *